US006525494B2

(12) United States Patent
Bae et al.

(10) Patent No.: US 6,525,494 B2
(45) Date of Patent: Feb. 25, 2003

(54) ELECTRON GUN FOR COLOR CATHODE RAY TUBE

(75) Inventors: Min-cheol Bae, Kyungki-do (KR); Young-gon Hong, Kyungki-do (KR); Woo-seok Huh, Seoul (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 10/046,412

(22) Filed: Jan. 16, 2002

(65) Prior Publication Data

US 2002/0130623 A1 Sep. 19, 2002

(30) Foreign Application Priority Data

Mar. 13, 2001 (KR) ..... 2001-12891

(51) Int. Cl.[7] ..... G09G 1/04
(52) U.S. Cl. ..... 315/382; 315/369
(58) Field of Search ..... 315/15, 16, 368, 315/369, 382, 368.15; 313/412, 428

(56) References Cited

U.S. PATENT DOCUMENTS 4,701,677 A 10/1987 Ashizaki et al.
4,814,670 A 3/1989 Suzuki et al.
5,027,043 A 6/1991 Chen et al.
6,031,346 A * 2/2000 Shirai et al. ..... 315/382
6,051,919 A 4/2000 Shirai et al.
6,304,026 B1 * 10/2001 Nakamura et al. ..... 313/414
6,313,576 B1 * 11/2001 Shirai et al. ..... 313/414
6,353,282 B1 * 3/2002 Tojyou et al. ..... 313/441
6,400,105 B2 * 6/2002 Uchida et al. ..... 315/382
6,404,149 B1 * 6/2002 Ueno et al. ..... 315/382
6,424,084 B1 * 7/2002 Kimiya et al. ..... 313/414
6,456,017 B1 * 9/2002 Bae et al. ..... 315/369
6,472,808 B1 * 10/2002 Uchida et al. ..... 313/414

FOREIGN PATENT DOCUMENTS

KR 1999-0069150 9/1999

* cited by examiner

*Primary Examiner*—Don Wong
*Assistant Examiner*—Minh D A
(74) *Attorney, Agent, or Firm*—Leydig, Voit & Mayer, Ltd.

(57) ABSTRACT

An electron gun for a color CRT includes a triode including cathodes for emitting electron beams, a control electrode, and a screen electrode, at least two focusing electrodes on the same axis of the triode portion for forming a quadrupole lens, and a final focusing electrode forming a large diameter lens with the focusing electrodes and through which three electron beams commonly pass. The electron gun includes a correction unit producing a correction force acting on the three electron beams and that is larger for two side electron beams than for a central electron beam of the three electron beams when a dynamic voltage, synchronized with a deflection signal, is applied to at least one of the focusing electrodes for forming the quadrupole lens.

26 Claims, 8 Drawing Sheets

ELECTRON GUN FOR COLOR CATHODE RAY TUBE

BACKGROUND OF THE INVENTION

1. Field of the Invention

The present invention relates to an electron gun for a color cathode ray tube (CRT), and, more particularly, to an in-line electron gun for a color CRT having improved electrodes that form at least one quadrupole lens.

2. Description of the Related Art

A typical electron gun for a color CRT is installed in a neck portion of the CRT and emits thermal electrons. The performance of the color CRT depends on the state of electron beams emitted from the electron gun and landing on a fluorescent film. Thus, numerous electron guns have been developed to improve focus properties and reduce aberration of an electron lens so that the electron beams emitted from the electron gun accurately land on phosphor dots of the fluorescent film. In particular, to reduce the total length of a CRT, the deflection angle of the electron beams is increased and the length of the electron gun is reduced. Since the focusing distance of an electron beam landing on a peripheral portion of a fluorescent film is larger than that of an electron beam landing on a central portion of the fluorescent film, the focus of the electron beams at the peripheral portion of a screen is inferior to the focus at the central portion of the fluorescent film.

As deflection angle increases, an incident angle of an electron beam with respect to the fluorescent film decreases. Accordingly, the distortion of the electron beam increases exponentially with deflection angle so that the diameter of a spot produced by an electron beam landing on the fluorescent film increases. The electron beam emitted from the electron gun is converged throughout the entire surface of a screen by a non-uniform electric field including a pincushion horizontal deflection electric field and a barrel vertical deflection electric field generated by a deflection electric field of the electron gun. This non-uniform electric field diverges the beam horizontally and focuses the beam vertically, forming a horizontally elongated beam at the periphery of a screen, lowering resolution. Of three in-line electron beams lying in a horizontal plane and produced by an electron gun for a color CRT, the two outside electron beams are more affected by astigmatism than is the central electron beam that is disposed between the outside beams. It is advantageous to increase a correction force applied to the outside electron beams of the three in-line electron beams relative to the force applied to the central electron beam. Conventional electron guns adopt quadrupole lenses, the operation of which is described below, to adjust the length of focus and compensate for the distortion of an electron beam.

When a dynamic voltage applied to an electrode is increased as an electron beams emitted from a triode portion of the electron gun pass a pre-focus point and arrive at a quadrupole lens, the electron beams move in an electric field direction of the quadrupole lens. The electrons of the electron beams receive a divergent force in the vertical direction and a focusing force in the horizontal direction. Thus, when the beams are deflected toward the peripheral portion of a screen, the distortion of the electron beams due to the deflection electric field, the incident angle of the electron beams, and the curvature of a surface of the screen, is compensated. However, when the dynamic voltage applied to the electrode forming the quadrupole lens increases, the focal lengths and the distortions of each of the electron beams, among the three in-line electron beams, are different, because of corrections due to the diameter of a large diameter electron lens and a difference in the magnifying power of the outside electron beams as compared to the central electron beam.

Electron guns correcting astigmatism of an electron beam deflected toward the peripheral portion of a screen are disclosed in U.S. Pat. No. 4,701,677, U.S. Pat. No. 4,814,670, and U.S. Pat. No. 5,027,043.

Electron guns described in these publications include a means for converting an electron beam from a linear path, including a quadrupole lens, to correct astigmatism with a self convergence deflection yoke. The quadrupole lens has different voltages applied to electrodes where vertically elongated electron beam passing holes or horizontally elongated electron beam passing holes are located. This electron gun can converge the three in-line electron beams at one point and correct distortion of the beam due to vertical and horizontal deflection magnetic fields deflecting of the electron beam.

As the surface of a CRT becomes flatter and the deflection angle of electron beams increases, the difference in the focal lengths between the central and peripheral portions of a screen increases toward the periphery. Astigmatism of the electron beams at the periphery of the screen is thus produced by the deflection yoke. Therefore, an electron gun needs strong astigmatism and focal length correction forces to avoid loss of resolution at the periphery of the screen.

To obtain the strong astigmatism and focal length correction forces, a large difference in electric potential between electrodes forming the quadrupole lens and, accordingly, a high voltage, is needed. However, the high voltage may cause a problem in circuit reliability and withstand voltage between the electrodes of an electron gun. Also, when an electron beam is incident on the periphery of a screen, the incident angle of the beam decreases horizontally and increases vertically due to the function of the quadrupole lens adjacent to the main lens, that is, focusing the beam horizontally and diverging the beam vertically. Thus, the horizontal dimension of a spot at the periphery of a screen increases. The astigmatism varying with the deflection of an electron beam becomes serious as the deflection angle of the electron beam by the deflection yoke increases. Also, convergence is deteriorated.

A color CRT having a quadrupole lens compensating for these problems is disclosed in U.S. Pat. No. 6,051,919. In this CRT, the length of a plate of each plate electrode, at surfaces forming a quadrupole lens and facing each other, is different. The length at the central electron beam is longer than at the outside electron beams. Thus, the central electron beam has a stronger focus correction for correcting convergence and astigmatism at the peripheral of a screen than the outside electron beams. However, in the CRT having this quadrupole lens, as the deflection angle of an electron beam increases, the dynamic voltage applied to the electrode of the quadrupole lens is increased. As the dynamic voltage increases, the difference in the astigmatism correction of the central electron beam and of the side electron beams increases at the periphery of a screen, so that the focus property deteriorates.

In particular, this differential astigmatism correction phenomenon occurs severely in an electron gun with a large diameter electrode and a main lens. That is, when a dynamic voltage synchronized with a deflection signal is applied to the large diameter electrode, since the ratio of change in focusing of an electrostatic lens in vertical and horizontal directions for the central electron beam is greater than that for each of the side electron beams, the differential astigmatism correction is severe. This phenomenon occurs because equipotential lines 2 (see FIG. 2) are gradually distributed in the horizontal direction, compared to equipotential lines 1 (see FIG. 1) in the vertical direction, in an area through which the central electron beam passes, as shown in FIGS. 1 and 2. Thus, the effective diameter of the electrostatic lens in the horizontal direction is greater than in the vertical direction. When the strength of the main lens changes in response to a change in the dynamic voltage, the rate of change in the vertical direction is greater than in the vertical direction.

However, since the side electron beams are positioned at the side of the large diameter lens, when the dynamic voltage is changed, the effect of the change of the equipotential lines in the horizontal direction is greater at the central portion. Since the shape of the equipotential lines changes simultaneously for all electron beams in the horizontal direction, the rate of vertical elongation of the side electron beams is less than the rate of elongation of the central electron beam. Therefore, as shown in FIG. 3, the dynamic voltage to deflect the side electron beams toward the periphery of a screen needs to be higher voltage than the dynamic voltage applied to deflect the central electron beam.

Consequently, in an electron gun with a large diameter main lens, when the dynamic voltage is applied, to obtain high resolution at both the central portion and the periphery of a screen, a higher voltage needs to be applied to the side electron beams or a stronger quadrupole lens needs to be provided for the side electron beams.

SUMMARY OF THE INVENTION

To solve the above-described problems, it is an object of the present invention to provide an electron gun for a color CRT which provides a uniform electron beam spot throughout the entire fluorescent film by correcting astigmatism and improving the focusing property with a deflection yoke for the three electron beams landing on the periphery of a fluorescent film, as the deflection angle increases.

According to a first aspect of the invention, an electron gun for a color CRT includes a triode portion including cathodes for emitting electron beams, a control electrode, and a screen electrode; first and second focusing electrodes located on a common axis with the triode portion for forming a quadrupole lens; and a final focusing electrode forming a large diameter lens with the focusing electrodes and including an opening through which three electron beams commonly pass, the three electron beams lying in a horizontal plane and including a central electron beam and two side electron beams on opposite sides of the central electron beam, wherein the first and second focusing electrodes include a correction unit providing a correction force acting on the three electron beams and that is larger for the two side electron beams than for the central electron beam when a dynamic voltage, synchronized with a deflection signal, is applied to at least one of the first and second focusing electrodes for forming the quadrupole lens.

Further, in an electron gun according to the invention, each of the first and second focusing electrodes include plates facing each other, each plate having three circular electron beam passing holes, including a central electron beam passing hole and two side electron beam passing holes on opposite sides of the central beam passing hole, and the correction unit comprises on the first focusing electrode, respective vertical blades extending from the plate of the first focusing electrode toward the second focusing electrode and located adjacent each of the electron beam passing holes, wherein the vertical blades located adjacent the side electron beam passing holes, but not adjacent the central beam passing hole, extend closer to the second focusing electrode than other vertical blades; and on the second focusing electrode, respective horizontal blades extending from each of upper and lower horizontal sides of the plate of the second focusing electrode and being electrically longer at positions aligned with and corresponding to the two side electron beam passing holes than at a position aligned with and corresponding to the central electron beam passing hole.

According to another aspect of the invention, an electron gun for a color CRT includes, a triode portion including cathodes for emitting electron beams, a control electrode, and a screen electrode; first and second focusing electrodes located on a common axis with the triode portion; third and fourth focusing electrodes for forming a quadrupole lens; and a final focusing electrode adjacent the fourth focusing electrode, forming a large diameter lens, and including an opening through which three electron beams commonly pass, the three electrode beams lying in a horizontal plane and including a central electron beam and two side electron beams on opposite sides of the central electron beam wherein the first and second focusing electrodes include a correction unit providing a correction force acting on the three electron beams and that is larger for the two side electron beams than for the central electron beam when a dynamic voltage, synchronized with a deflection signal, is applied to the fourth electrode for forming the quadrupole lens.

According to a third aspect of the invention, an electron gun for a color CRT includes a triode portion including cathodes for emitting electron beams, a control electrode, and a screen electrode; first and second focusing electrodes located on a common axis with the triode portion; third, fourth, and fifth focusing electrodes for forming a quadrupole lens; and a final focusing electrode adjacent the fifth focusing electrode, forming a large diameter lens, and including an opening through which three electron beams commonly pass, the three electrode beams lying in a horizontal plane and including a central electron beam and two side electron beams on opposite sides of the central electron beam wherein the third, fourth, and fifth focusing electrodes include a correction unit providing a correction force acting on the two side electron beams and that is larger for the two side electron beams than for the central electron beam when a dynamic voltage, synchronized with a deflection signal, is applied to at least one of the third and fifth focusing electrodes for forming the quadrupole lens.

BRIEF DESCRIPTION OF THE DRAWINGS

The above object and advantages of the present invention will become more apparent by describing in detail preferred embodiments with reference to the attached drawings in which.

DETAILED DESCRIPTION OF THE INVENTION

An electron gun according to the present invention incorporates a large diameter lens through which three electron beams commonly pass. When three electron beams are deflected by a deflection yoke, the strength of a quadrupole lens acting on the three electron beams varies such that a correction force acting on the side electron beams is greater than that acting on the central electron beam.

First Electron Gun Embodiment

Figure 1:
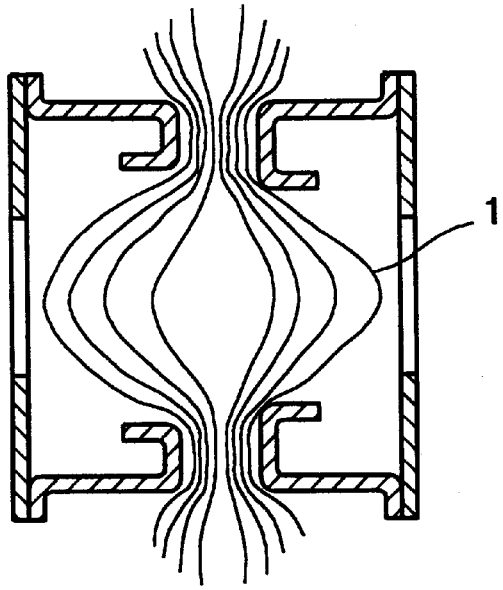
FIG. 1 is a vertical sectional view of an electrode having a large diameter main lens.
Figure 2:
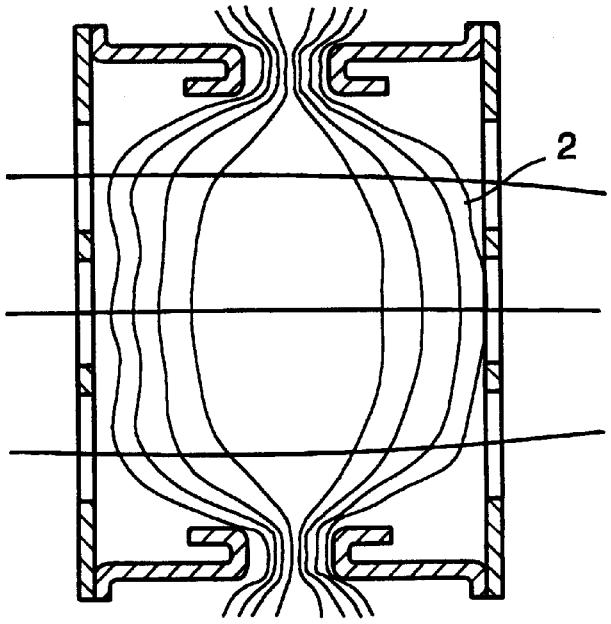
FIG. 2 is a horizontal section view of the electrode of FIG. 1.
Figure 3:
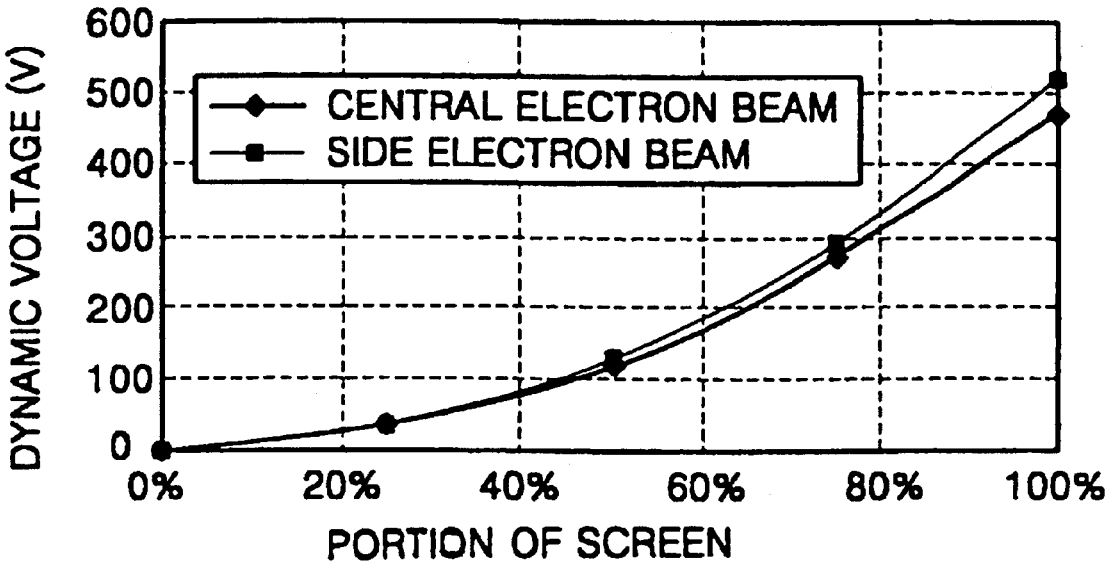
FIG. 3 is a graph showing the relationship between a dynamic voltage and a scanning position of electron beams of the conventional electron gun with a quadrupole lens.
Figure 4:
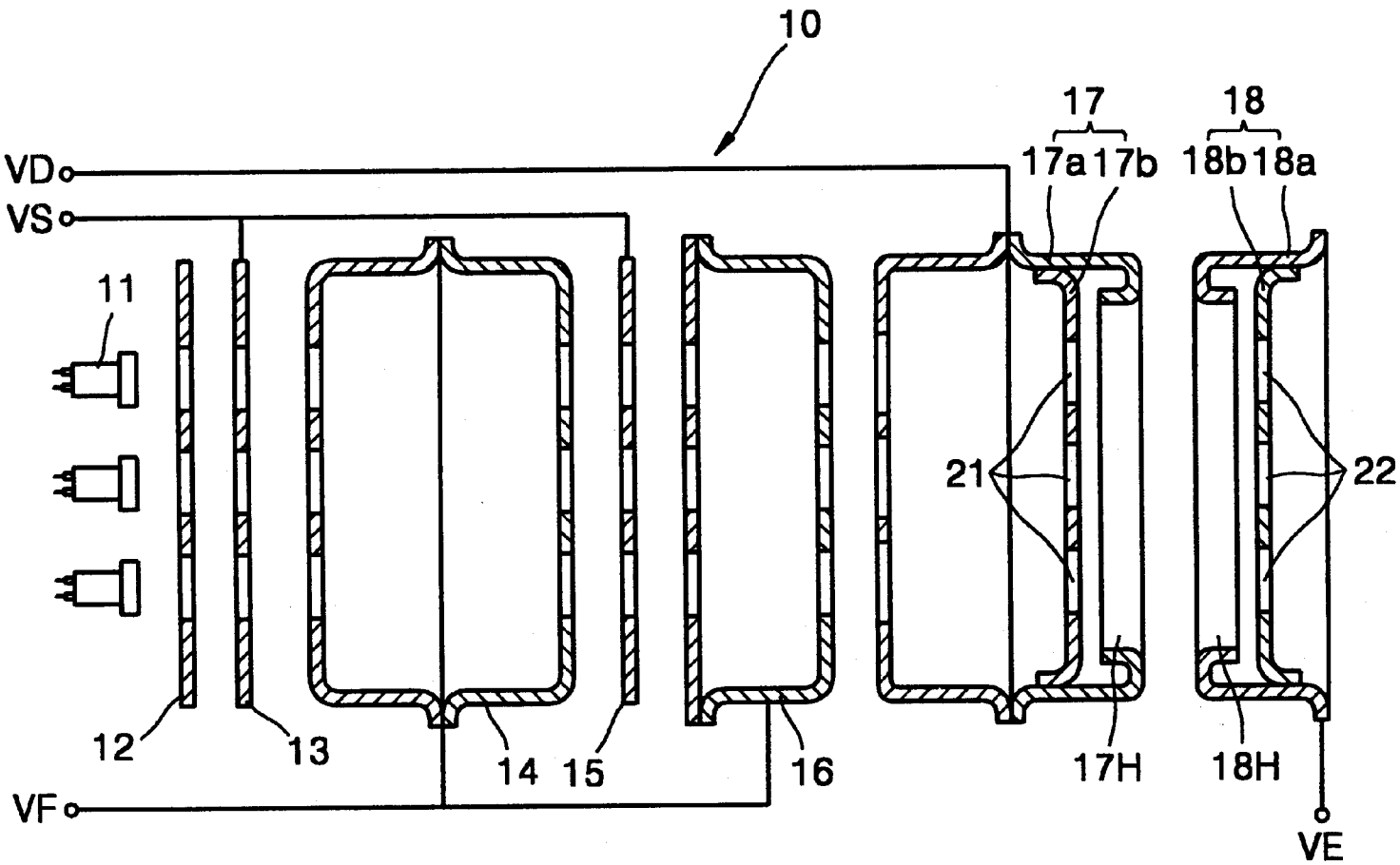
FIG. 4 is a sectional view of an electron gun for a color CRT according to the present invention.

A preferred embodiment of the present invention is shown in FIG. 4. As shown in the drawing, an electron gun 10 includes a triode portion including cathodes 11 which are electron beam emitting sources, a control electrode 12, and a screen electrode 13, first and second focusing electrodes 14 and 15 lying on the same axis of the triode portion, third and fourth focusing electrodes 16 and 17 forming at least one quadrupole lens, and a final focusing electrode 18 adjacent to the fourth focusing electrode 17 and forming a large diameter main lens through which the three electron beams commonly pass. A correction means providing a larger correction force acting on both side electron beams than on the central electron beam, is located at the third and fourth focusing electrodes 16 and 17 that form the quadrupole lens.

Each electrode forming the electron gun includes one or three electron beam passing holes. In particular, the output side of the fourth focusing electrode 17 and the input side of the final focusing electrode 18, forming the large diameter main lens, include outer electrode members 17*a* and 18*a* with large diameter electron beam passing holes 17H and 18H through which all three electron beams commonly pass and inner electrode plates 17*b* and 18*b*, inside the outer electrode members 17*a* and 18*a*, with three independent electron beam passing holes 21 and 22.

First Correction Means Embodiment

Figure 5:
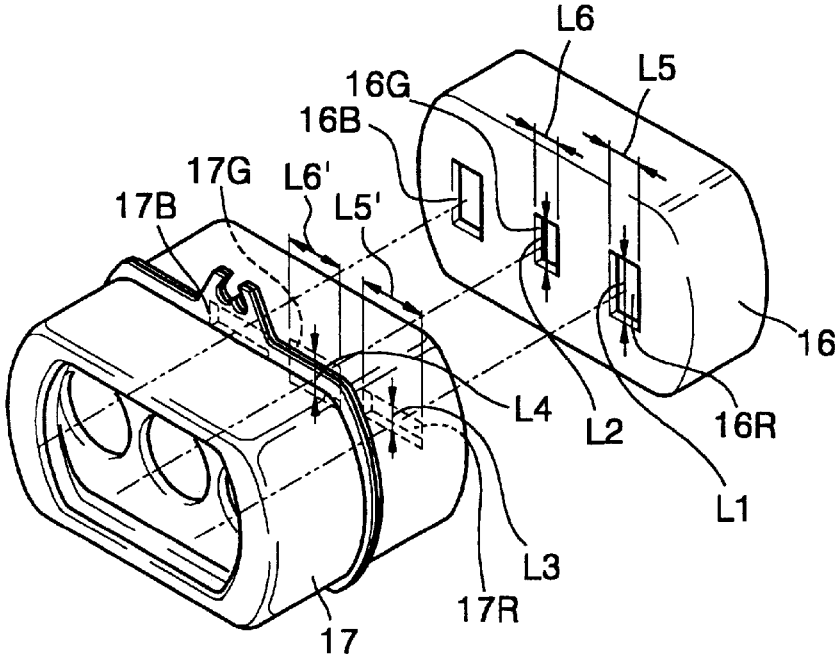
FIG. 5 is an exploded perspective view showing the electrodes forming the quadrupole lens of FIG. 4.

In the electron gun 10, as shown in FIG. 5, three electron beam passing holes 16R, 16G, and 16B, which are vertically elongated and in-line, i.e., are aligned along a common horizontal line, are located in the output side surface of the third focusing electrode 16. The input side of the fourth focusing electrode 17 includes three horizontally elongated electron beam passing holes 17R, 17G, and 17B. In the correction means, the vertical length L1 of each of the side electron beam passing holes 16R and 16B is larger than the respective vertical lengths, L2 and L4, of the central electrode beam passing holes 16G and 17G. The vertical lengths L3 of each of the side electrode beam passing holes 17R and 17B are smaller than the vertical length L4 of the central electron beam passing hole 17G.

The respective horizontal lengths L5 and L5' of each of the side electron beam passing holes 16R and 16B, and 17R and 17B are preferably larger than the respective horizontal lengths L6 and L6' of each of the central electron beam passing holes 16G and 17G. Among the three electron beam passing holes 16R, 16G, and 16B, and 17R, 17G, and 17B, respectively located in the third and fourth focusing electrodes 16 and 17, forming a quadrupole lens, the ratio of the vertical length to the horizontal length of each of the side electron beam passing holes is preferably less than the ratio of the vertical length to the horizontal length of the central electron beam passing holes.

Although the electron beam passing holes 16R, 16G, 16B, 17R, 17G, and 17B forming the third and fourth focusing electrodes 16 and 17 have vertically elongated and horizontally elongated rectangular shapes, the shapes are not limited to the illustrated embodiments and any structures forming the quadrupole lens may be adopted.

Second Through Fifth Correction Means Embodiments

FIGS. 6 through 9 show a correction means in an electron gun according to another preferred embodiment of the present invention. Each of these embodiments includes two focusing electrodes. The focusing electrode farther from the cathodes includes horizontal blades projecting from upper and lower horizontal sides of a plate of that focusing electrode. The electron beam passing holes are all circular and substantially the same size. In all of the embodiments of FIGS. 6–9, these horizontal blades include a feature so the blades apply a greater electrical force to the side electron beams than to the central electron beams, i.e., the horizontal blades have electrically different lengths at positions aligned with and corresponding to the side electron beam passing holes and at a position corresponding to the central electron beam passing hole. The horizontal blades may be electrically and/or physically longer, may include transverse extensions, or may be physically closer together opposite the side electron beam passing holes than opposite the central beam passing hole to achieve the greater influence on the side electron beams as compared to the central electron beam. The other focusing electrode in these embodiments includes vertical blades projecting toward the focusing electrode that is farther from the cathodes. The vertical blades are located adjacent to and on each side of the three beam passing holes. The two outer blades are longer to influence the side electron beams more than the central electron beam.

Figure 6:
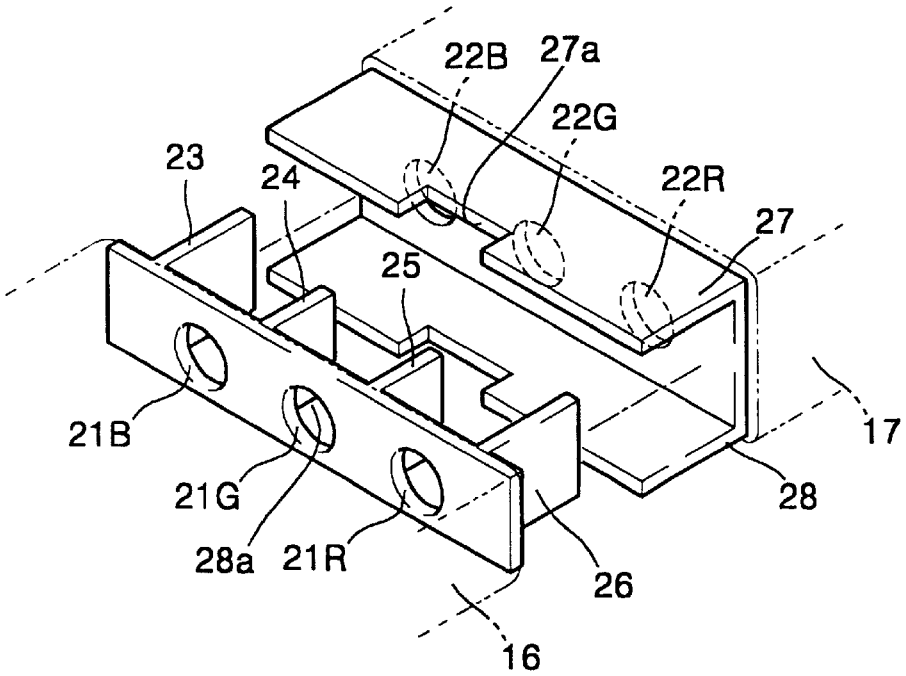
FIGS. 6, 7, 8, and 9 are views showing electrodes forming quadrupole lenses according to other preferred embodiments of the present invention.

In the correction means embodiment of FIG. 6, circular electron beam passing holes 21R, 21G, and 21B, and 22R, 22G, and 22B, are located in surfaces of the third and fourth focusing electrodes 16 and 17 facing each other, respectively. Respective pairs of vertical blades 23, 24, 25, and 26 are disposed on opposite sides of the electron beam passing holes 21R, 21G, and 21B and on the output side surface of the third focusing electrode 16. The vertical blades 23 and 26 disposed at the outside, i.e., next to the side electron beam passing holes 21R and 21B, are longer than the vertical blades 24 and 25. Horizontal blades 27 and 28 extend from upper and lower portions of the plate of the fourth focusing electrode 17 that includes the three electron beam passing holes 22R, 22G, and 22B. The blades extend toward the third focus electrode 16. Respective indentations 27*a* and 28*a* are located in the horizontal blades 27 and 28 at central regions corresponding to and aligned with the central electron beam passing holes 22G and 22G. At the indentations 27*a* and 28*a* the horizontal blades 27 and 28 do not extend as far toward the focusing electrode 16 as elsewhere.

Figure 7:
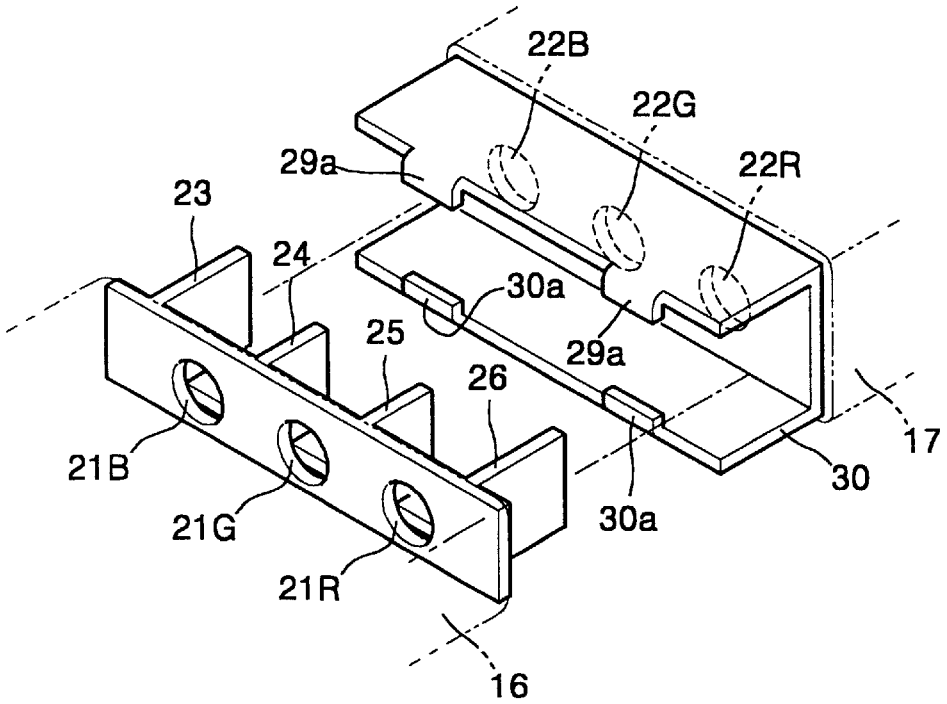

In other preferred embodiments, the horizontal blades 27 and 28 may have various shapes different from those in FIG. 6. As shown in FIG. 7, horizontal blades 29 and 30 each have two extensions 29*a* and 30*a* extending generally parallel to the plate of the fourth focus electrode 17 that includes the beam passing holes 22R, 22G, and 22B and extending from the blades 29 and 30, respectively. The extension portions 29*a* and 30*a* are aligned with portions of the side electron beam passing holes 22R and 22B at the input side surface of the fourth focusing electrode 17.

Figure 8:
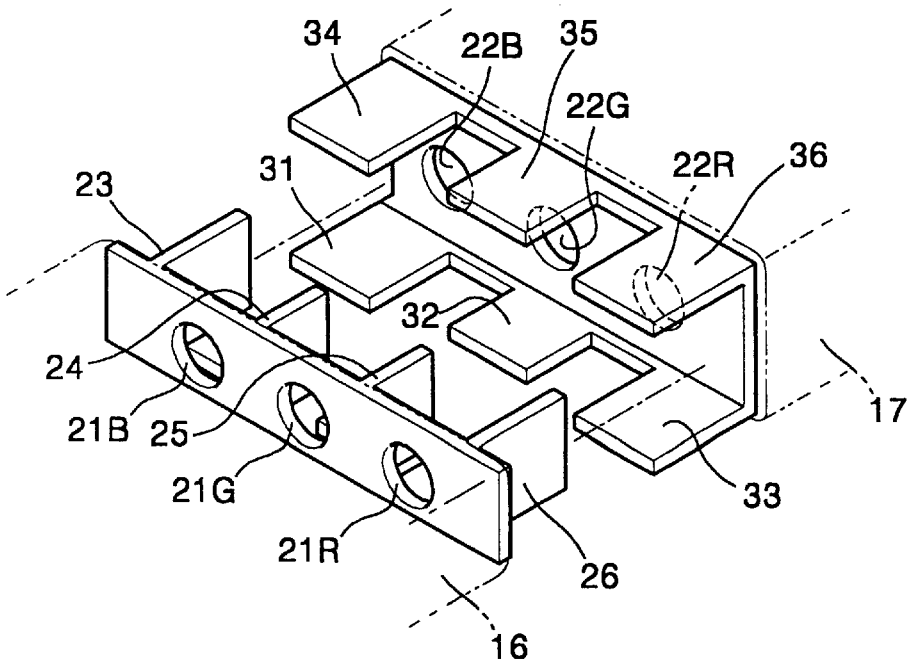

Alternatively, as shown in FIG. 8, horizontal blades 31–33 and 34–36 respectively extend toward the focusing electrode 16 from upper and lower portions of the plate of the focusing electrode 17 containing the three electron beam passing holes 22R, 22G, and 22B. Pairs of the blades are aligned with each of the three electron beam passing holes of the fourth focusing electrode 17 and are aligned between respective pairs of the vertical blades 23–26 of the third focusing electrode 16. The lengths of each of the pairs of the outside horizontal blades 31 and 34, and 33 and 36, are longer than the lengths of the pair of central horizontal blades 32 and 35 which are aligned with the central electron beam passing hole 22G.

Figure 9:
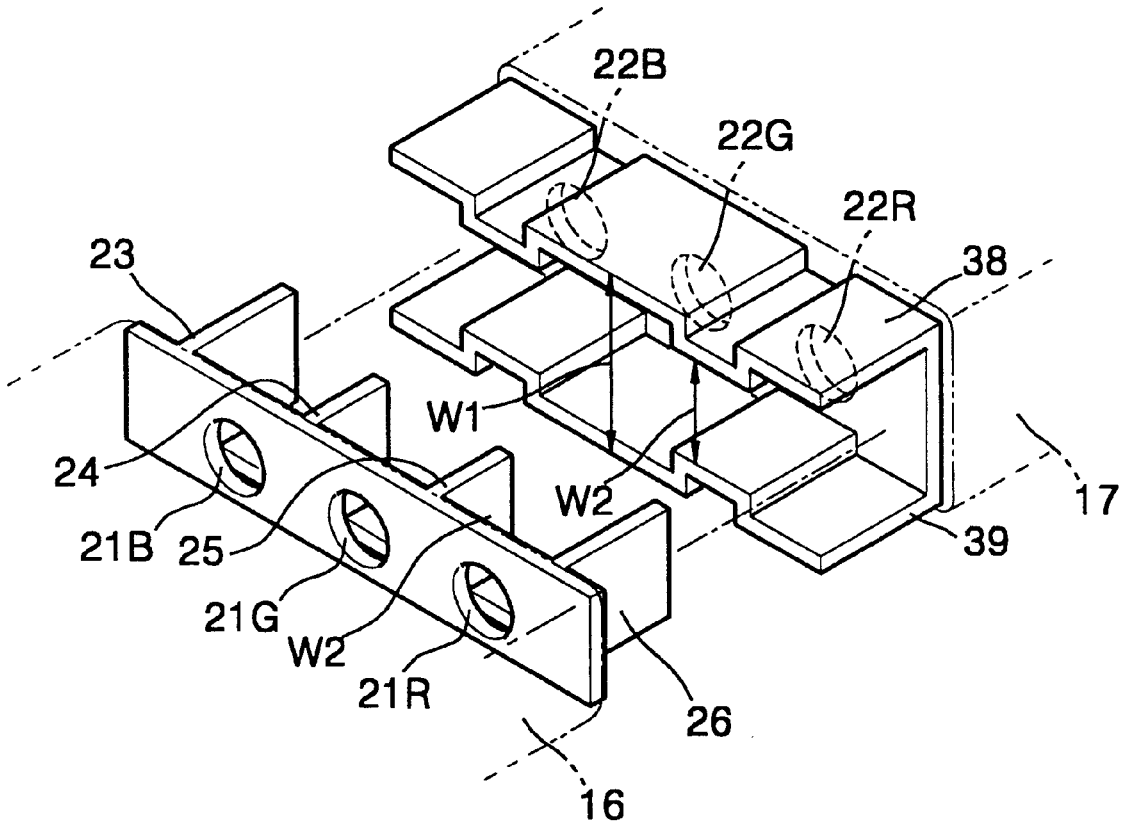

As shown in the embodiment of the FIG. 9, horizontal blades 38 and 39 extend from upper and lower portions of the plate of the fourth focusing electrode 39 containing the three electron beam passing holes 22R, 22G, and 22B, toward the third focusing electrode 16. The horizontal blades 38 and 39 each include two stepped portions. The vertical length W1 between the pair of blades at a location opposite the central electron beam passing hole 22G is larger than the vertical lengths W2 at locations aligned with the side electron beam passing holes 22R and 22B.

A predetermined voltage is applied to the electrodes of the embodiments shown in FIGS. 6–9 when incorporated in the electron gun embodiment of FIG. 4. A constant voltage VS is applied to the screen electrode 13 and the second focusing electrode 15. A focus voltage VF, higher than the constant voltage VS, is applied to the first and third focusing electrodes 14 and 16. A parabolic dynamic voltage VD, synchronized with a deflection signal, is applied to the fourth focusing electrode 17. An anode voltage VE, which is a high voltage, is applied to the final focusing electrode 18. The anode voltage VE is typically 28–35 kV and the focus voltage VF is set to be 28% of the anode voltage VE. The dynamic voltage VD is set to be 28±3% of the anode voltage VE and uses the focus voltage VE as a base voltage.

Sixth Correction Means Embodiment

Figure 10:
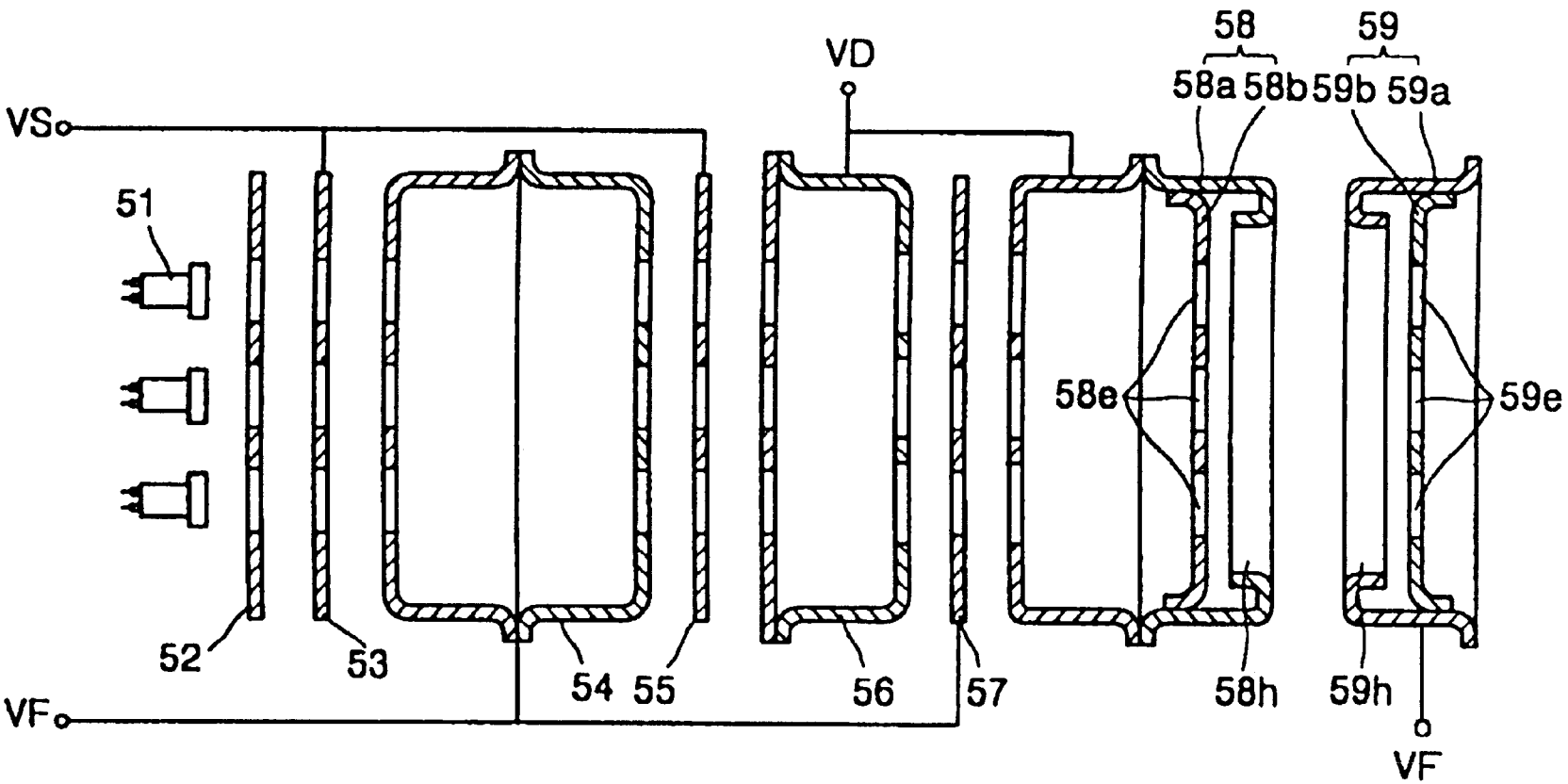
FIG. 10 is a sectional view showing an electron gun according to another preferred embodiment of the present invention.
Figure 11:
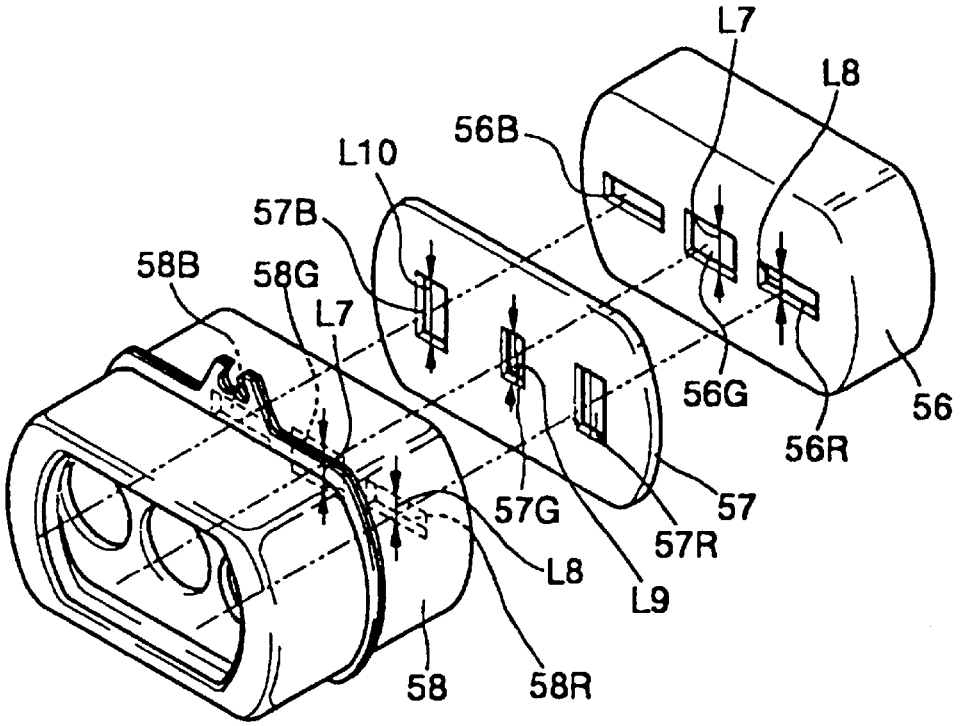
FIG. 11 is an exploded perspective view showing electrodes forming the quadrupole lens of FIG. 10.

FIGS. 10 and 11 show electron guns having correction means according to another preferred embodiment of the present invention. As shown in FIG. 10, the electron gun includes three cathodes 51, a control electrode 52, and a screen electrode 53 which are in-line and form a triode portion, first, second, and third focusing electrodes 54, 55, and 56 sequentially located relative to the screen electrode 53, for forming an auxiliary lens, fourth and fifth focusing electrodes 57 and 58 adjacent the third focusing electrode 56 and forming a quadrupole lens, and a final focusing electrode 59 adjacent the fifth focusing electrode 58 as a large diameter main lens through which three electron beams commonly pass. A correction means is installed at the third, fourth, and fifth focusing electrodes 56, 57, and 58 forming the quadrupole lens. The correction means produces a correction force applying a greater correction force to the side electrode beams than to the central electron beam by changing the strength of the quadrupole lens acting on three electron beams, depending on the degree of deflection.

The output side of the fifth focusing electrode 58 and the input side of the final focusing electrode 59, respectively including the large diameter main lens, include outer electrode members 58*a* and 59*a*, large diameter electron beam passing holes 58H and 59H through which the three electron beams commonly pass, and inner electrode members 58*b* and 59*b* installed inside the outer electrode members 58*a* and 59*a* and respectively including three independent electron beam passing holes 58*e* and 59*e*.

In the electron gun embodiment of FIG. 10, as shown in the detail view of FIG. 11, three horizontally elongated in-line electron beam passing holes 56R, 56G, and 56B are located in a plate of the third focusing electrode 56. The fourth focusing electrode 57 is a plate including three vertically elongated electron beam passing holes 57R, 57G, and 57B. A plate of the fifth focusing electrode 58 includes three horizontally elongated in-line electron beam passing holes 58R, 58G, and 58B. The correction means includes the electron beam passing holes 56R, 56G, 56B, 57R, 57G, 57B, 58R, 58G, and 58B.

In the correction means of this embodiment, the three horizontally elongated electron beam passing holes 56R, 56G, and 56B, and 58R, 58G, and 58B, form a quadrupole lens between an output side of the third focusing electrode 56 and an input side of the fifth focusing electrode 58. The vertical lengths L7 of the central electron beam passing holes 56G and 58G are larger than the vertical lengths L8 of the side electron beam passing holes 56R and 56B, and 58R and 58B. The vertical length L9 of the central electron beam passing hole 57G is smaller than the vertical lengths L10 of the electron beam passing holes 57R and 57B disposed on opposite sides of the electron beam passing hole 57G. Further, the area of the central electron beam passing hole 57G is smaller than the respective areas of the side electron beam passing holes 57R and 57B.

Operation of Electron Guns Including Correction Means

The operation of the electron guns embodiment of FIGS. 4 and 10 is now described. A voltage for driving the electron gun of FIG. 10 is applied to each electrode forming the electron gun. That is, a constant voltage VS is applied to the screen electrodes 13 and 53 and the second focusing electrodes 15 and 55. In the embodiment of FIG. 10, a focus voltage VF, higher than the constant voltage VS, is applied to the first and third focusing electrodes 14 and 16 and a focus voltage VF is applied to the first and fourth focusing electrodes 54 and 57. A parabolic dynamic voltage VD, synchronized with a deflection signal, is applied to the third focusing electrode in the embodiment of FIG. 4 and to the third and fifth focusing electrodes 56 and 58 in the embodiment of FIG. 10. An anode voltage VE, higher than the other voltages, is applied to the final focusing electrodes 18 and 59.

In the operation of a dynamic focus electron gun for a color CRT, as electric potentials are applied to the electrodes, an electron lens is generated by electric lines of force and equipotential lines between the respective electrodes, when an electron beam is scanned at the central portion of the fluorescent film and at the peripheral portion of the film.

When the electron beam is scanned onto the central portion of the fluorescent film, the dynamic voltage VD, using the focus voltage VF as a base voltage, is not applied. Thus, in the embodiment of FIG. 4, a pre-focus lens is formed between the screen electrode 13 and the first focus electrode 14. An auxiliary lens is formed between the first, second, and third focus electrodes 14, 15, and 16. Since the difference in electric potential between the third and fourth focusing electrodes 16 and 17 is small, a quadrupole lens affecting the electron beam is not formed. A main lens is formed between the fourth focusing electrode 17 and the final focusing electrode 18. Thus, the electron beam emitted from the cathode 11 is pre-focused and accelerated by the pre-focus lens and then finally focused and accelerated by the main lens so that it lands on the central portion of the fluorescent film.

When the electron beam emitted from the electron gun is scanned onto a peripheral portion of the fluorescent film, the dynamic voltage VD, synchronized with the deflection signal, is applied to the fourth focus electrode 17. Thus, the pre-focus lens is formed between the screen electrode 13 and the first focusing electrode 14. The auxiliary lens is formed by electric lines of force and equipotential lines, by the focus voltage VF and the constant voltage VS, between the first, second, and third electrodes 14, 15, and 16. A quadrupole lens is formed between the third and fourth focusing electrodes 16 and 17. As the dynamic voltage VD is applied, a large diameter main lens having a relatively lower magnifying power is formed between the fourth focusing electrode 18 and the final focusing electrode 19.

In the described state, the electron beams emitted from the cathode 11 are pre-focused and accelerated while passing the pre-focus lens and auxiliary lens and then pass through the quadrupole lens. The vertical length L1 of each of the side electron beam passing holes 16R and 16B of the third focusing electrode 16 is larger than the vertical length L2 of each of the central electron beam passing holes 16G and 17G. The vertical length L3 of each of the side electron beam passing holes 17R and 17B of the fourth focusing electrode 17 is larger than the vertical length L4 of the central electron beam passing hole 17G. The horizontal lengths L5 of each of the side electron beam passing holes 16R and 16B, and 17R and 17B is larger than the horizontal length L6 and L6' of each of the central electron beam passing holes 16G and 17G. Thus, the vertical divergent electric field of the quadrupole lens through which the side electron beams pass is stronger so that a correction force vertically elongating the electron beams is stronger than the correction by the quadrupole lens through which the central electron beam passes.

In detail, as the difference between the vertical component force and the horizontal force component of an electric field forming the quadrupole lens increases, deformation of the electric field becomes greater and the magnifying power of the quadrupole lens becomes greater. Among the electron beams passing holes of the quadrupole lens, the ratio of the vertical length to the horizontal length of the side electron beam passing holes is less than the ratio of the vertical length to the horizontal length of the central electron beam passing hole through which the central electron beam passes. Therefore, the action of the quadrupole lens formed by the side electron beam passing holes 16R, 16B, 17R and 17B is stronger than the quadrupole lens formed by the central electron beam passing holes 16G and 17G. Thus, of the three in-line electron beams passing through the electron beam passing holes, the side electron beams receive relatively greater electron beam correction than does the central electron beam.

An electron gun in which the side electron beams have different degrees of the vertical elongation compared to the central electron beam forms a uniform electron beam spot throughout the entire fluorescent film when deflected by the irregular magnetic field of the deflection yoke. In this process, since the dynamic voltage is applied to the fourth focusing electrode 17, the difference in voltage with respect to the final focusing electrode 18 decreases. Accordingly, the magnification power of the main lens is lowered, spherical aberration occurs, and the focal length increases.

In an electron gun according to a preferred embodiments, when a dynamic quadrupole lens is formed by the vertical and horizontal blades electrically connected to the third and fourth focusing electrodes 16 and 17, as shown in FIG. 9, since the length W2 between the horizontal blades at the regions aligned with the side electron beams is less than the length W1 between the horizontal blades at the portion aligned with the central electron beam, the force applied by the quadrupole lens to the side electron beams is greater than that applied to the central electron beam. Thus, as in a preferred embodiment of the correcting means, when the dynamic voltage is applied, a uniform focus property can be obtained at the peripheral portion of the fluorescent film.

The same actions by the vertical and horizontal blades can be obtained by adjusting the length of the horizontal and vertical blades or forming at an end portion of the horizontal blade an extension which varies the distance from each electron beam, as in the embodiments of FIGS. 6, 7, and 8.

In the case of the electron gun of FIG. 10, since correction of astigmatism of the electron beam is corrected by varying the vertical and horizontal lengths of the vertically elongated electron beam passing holes and the horizontally elongated electron beam passing holes, the same can be obtained.

As described above, in the electron gun for a color CRT according to the present invention, since the cross-sectional shape of each electron beam is changed by a focusing and diverging force of a quadrupole lens, when the electron beams are deflected by a irregular magnetic field of the deflection yoke, an increase of horizontal dimension and deformation of the electron beam can be prevented. Further, a uniform focus property can be obtained at the central portion and at peripheral portions of the screen.

Figure 12:
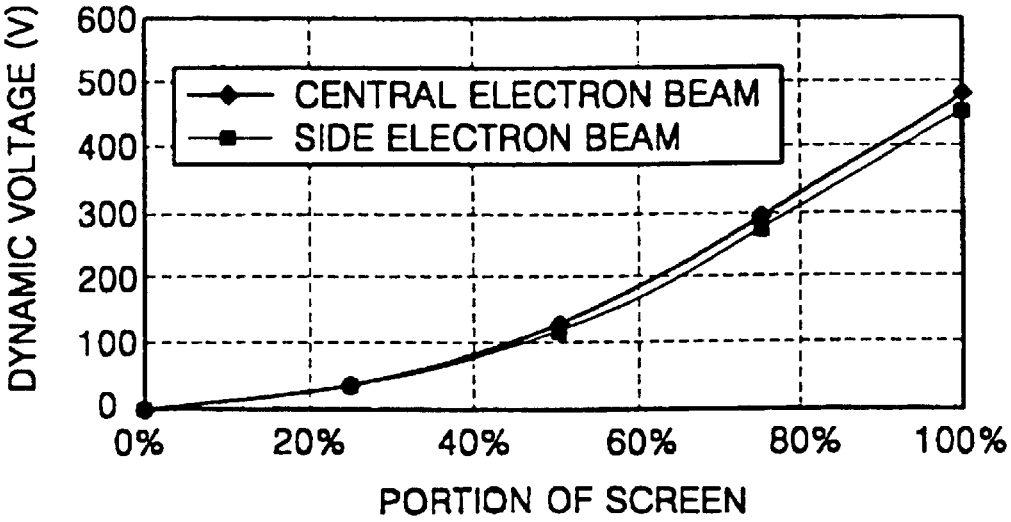
FIG. 12 is a graph showing the relationship between the dynamic voltage and the scanning position of an electron beam of the electron gun according to the present invention.

Therefore, as shown in FIG. 12, the dynamic voltage to deflect the side electron beams toward the periphery of a screen does not need to be much higher than the dynamic voltage to deflect the central electron beam.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An electron gun for a color CRT comprising:

a triode portion including cathodes for emitting electron beams, a control electrode, and a screen electrode;

first and second focusing electrodes located on a common axis with the triode portion for forming a quadrupole lens; and a final focusing electrode forming a large diameter lens with the focusing electrodes and including an opening through which three electron beams commonly pass, the three electron beams lying in a horizontal plane and including a central electron beam and two side electron beams on opposite sides of the central electron beam, wherein the first and second focusing electrodes include a correction unit providing a correction force acting on the three electron beams and that is larger for the two side electron beams than for the central electron beam when a dynamic voltage, synchronized with a deflection signal, is applied to at least one of the first and second focusing electrodes for forming the quadrupole lens.

2. The electron gun as claimed in claim 1, wherein the correction unit includes respective plates of the first and second focusing electrodes, each plate including a central and two side electron beam passing holes having respective vertical lengths perpendicular to the horizontal plane and horizontal lengths in the horizontal plane, wherein, in the plate of the second focusing electrode, the vertical lengths of the side electron beam passing holes are smaller than the vertical length of the central electron beam passing hole.

3. The electron gun as claimed in claim 1, wherein the correction unit includes respective plates of the first and second focusing electrodes, each plate including a central and two side electron beam passing holes having respective vertical lengths perpendicular to the horizontal plane and horizontal lengths in the horizontal plane, wherein, in the plate of the second focusing electrode, the horizontal lengths of the side electron beam passing holes are larger than the horizontal length of the central electron beam passing hole.

4. The electron gun as claimed in claim 1, wherein the correction unit includes respective plates of the first and second focusing electrodes, each plate including a central and two side electron beam passing holes having respective vertical lengths perpendicular to the horizontal plane and horizontal lengths in the horizontal plane, wherein, in the plate of the second focusing electrode, a ratio of the vertical length to the horizontal length of each of the side electron beam passing holes is smaller than a ratio of the vertical length to the horizontal length of the central electron beam passing hole.

5. The electron gun as claimed in claim 1, wherein the correction unit includes respective plates of the first and second focusing electrodes, each plate including a central and two side electron beam passing holes having respective vertical lengths perpendicular to the horizontal plane and horizontal lengths in the horizontal plane, wherein, in the plate of the first focusing electrode, the vertical and horizontal lengths of a central electron beam passing hole are smaller than vertical and horizontal lengths, respectively, of the side electron beam passing holes, and the horizontal length, but not the vertical length, of the central electron beam passing hole in the second focusing electrode is smaller than horizontal and vertical lengths, respectively, of the side electron beam passing holes in the second focusing electrode.

6. The electron gun as claimed in claim 1, further comprising a plate electrode including a central and two side electron beam passing holes having vertical and horizontal lengths, the plate electrode being located between the first and second focusing electrodes.

7. The electron gun as claimed in claim 6, wherein the correction unit includes respective plates of the first and second focusing electrodes, each plate including a central and two side electron beam passing holes having respective vertical lengths perpendicular to the horizontal plane and horizontal lengths in the horizontal plane, wherein, in the plate of the plate focusing electrode, the vertical and horizontal lengths of the central electron beam passing hole are smaller than the vertical and horizontal lengths of the side electron beam passing holes in the plate electrode, and the vertical length, but not the horizontal length, of the central electron beam passing hole in the first focusing electrode is larger than the vertical length and horizontal length, respectively, of the side electron beam passing holes in the first focusing electrode.

8. The electron gun as claimed in claim 7 wherein the correction unit further includes the horizontal length, but not the vertical length, of the central beam passing hole of the second focusing electrode being smaller than the horizontal length and vertical length, respectively, of the side electron beam passing holes in the second focusing electrode.

9. The electron gun as claimed in claim 1, wherein each of the first and second focusing electrodes include plates facing each other, each plate having three circular electron beam passing holes, including a central electron beam passing hole and two side electron beam passing holes on opposite sides of the central beam passing hole, and the correction unit comprises:

on the first focusing electrode, respective vertical blades extending from the plate of the first focusing electrode toward the second focusing electrode and located adjacent each of the electron beam passing holes, wherein the vertical blades located adjacent the side electron beam passing holes, but not adjacent the central beam passing hole, extend closer to the second focusing electrode than other vertical blades; and on the second focusing electrode, respective horizontal blades extending from each of upper and lower horizontal sides of the plate of the second focusing electrode and having electrically different lengths at positions aligned with and corresponding to the two side electron beam passing holes and at a position aligned with and corresponding to the central electron beam passing hole.

10. The electron gun as claimed in claim 9, wherein the horizontal blades on the second focusing electrode extend a shorter distance toward the first focusing electrode at the positions aligned with and corresponding to the central electron beam passing hole than elsewhere.

11. The electron gun as claimed in claim 9, wherein each of the horizontal blades includes pairs of extension portions generally parallel to the plate of the second focusing electrode at portions of the horizontal blades aligned with and corresponding to the side electron beam passing holes, the extension portions narrowing an opening between the horizontal blades at the positions aligned with and corresponding to the side electron beam passing holes relative to an opening between the horizontal blades at the position aligned with and corresponding to the central beam passing hole.

12. The electron gun as claimed in claim 9, wherein each of the horizontal blades includes three horizontal blade portions extending from each of the upper and lower horizontal sides of the second focusing electrode, each blade portion being aligned with and corresponding to a respective one of the side and central electron beam passing holes, the blade portions being aligned with and corresponding to the central electron beam hole not extending as far toward the first focusing electrode as blade portions aligned with and corresponding to the central electron beam passing hole.

13. The electron gun as claimed in claim 9, wherein the horizontal blades include bends about horizontal axes so that the horizontal blades are not planar and are closer to each other at regions aligned with and corresponding to the side electron bean passing holes than at a region corresponding to and aligned with the central electron beam passing hole.

14. The electron gun as claimed in claim 9, wherein the horizontal blades are electrically longer at the positions aligned with and corresponding to the side electron beam passing holes than at the position aligned with and corresponding to the central electron beam passing hole.

15. An electron gun for a color CRT comprising:

a triode portion including cathodes for emitting electron beams, a control electrode, and a screen electrode;

first and second focusing electrodes located on a common axis with the triode portion;

third and fourth focusing electrodes for forming a quadrupole lens; and a final focusing electrode adjacent the fourth focusing electrode, forming a large diameter lens, and including an opening through which three electron beams commonly pass, the three electrode beams lying in a horizontal plane and including a central electron beam and two side electron beams on opposite sides of the central electron beam wherein the first and second focusing electrodes include a correction unit providing a correction force acting on the three electron beams and that is larger for the two side electron beams than for the central electron beam when a dynamic voltage, synchronized with a deflection signal, is applied to the fourth electrode for forming the quadrupole lens.

16. The electron gun as claimed in claim 15,wherein the correction unit includes respective plates of the third and fourth focusing electrodes, each plate including a central and two side electron beam passing holes having respective vertical lengths perpendicular to the horizontal plane and horizontal lengths in the horizontal plane, wherein, in the plate of the fourth focusing electrode, a ratio of the vertical length to the horizontal length of each of the side electron beam passing holes is smaller than a ratio of the vertical length to the horizontal length of the central electron beam passing hole.

17. The electron gun as claimed in claim 15, wherein the correction unit includes respective plates of the third and fourth focusing electrodes, each plate including a central and two side electron beam passing holes having respective vertical lengths perpendicular to the horizontal plane and horizontal lengths in the horizontal plane, wherein, in the plate of the third focusing electrode, the vertical and horizontal lengths of a central electron beam passing hole are smaller than vertical and horizontal lengths, respectively, of the side electron beam passing holes, and the horizontal length, electrode, is smaller than horizontal and vertical lengths, respectively, of the side electron beam passing holes in the fourth focusing electrode.

18. The electron gun as claimed in claim 15, wherein the third and fourth focusing electrodes include respective plates facing each other, each plate having three circular electron beam passing holes, including a central electron beam passing hole and two side electron beam passing holes on opposite sides of the central beam passing hole, and the correction unit comprises:

on the third focusing electrode, respective vertical blades extending from the plate of the third focusing electrode toward the fourth focusing electrode and located adjacent each of the electron beam passing holes, wherein the vertical blades located adjacent the side electron beam passing holes, but not adjacent the central beam passing hole, extend closer to the fourth focusing electrode than other vertical blades; and on the fourth focusing electrode, respective horizontal blades extending from each of upper and lower horizontal sides of the plate of the fourth focusing electrode and having electrically different lengths at positions aligned with and corresponding to the two side electron beam passing holes and at a position aligned with and corresponding to the central electron beam passing hole.

19. The electron gun as claimed in claim 18, wherein the horizontal blades on the fourth focusing electrode extend a shorter distance toward the third focusing electrode at the positions aligned with and corresponding to the central electron beam passing hole than elsewhere.

20. The electron gun as claimed in claim 18, wherein each of the horizontal blades includes pairs of extension portions generally parallel to the plate of the fourth focusing electrode, at portions of the horizontal blades aligned with and corresponding to the side electron beam passing holes, the extension portions narrowing an opening between the horizontal blades at the positions aligned with and corresponding to the side electron beam passing holes relative to an opening between the horizontal blades at the position aligned with and corresponding to the central beam passing hole.

21. The electron gun as claimed in claim 18, wherein each of the horizontal blades includes three horizontal blade portions extending from each of the upper and lower horizontal sides of the fourth focusing electrode, each blade portion being aligned with and corresponding to a respective one of the side and central electron beam passing holes, the blade portions being aligned with and corresponding to the central electron beam hole not extending as far toward the third focusing electrode as other blade portions aligned with and corresponding to the central electron beam passing hole.

22. The electron gun as claimed in claim 18, wherein the horizontal blades include bends about horizontal axes so that the horizontal blades are not planar and are closer to each other at regions aligned with and corresponding to the side electron beam passing holes than at a region corresponding to an aligned with the central electron beam passing hole.

23. The electron gun as claimed in claim 18, wherein the horizontal blades are electrically longer at the positions aligned with and corresponding to the side electron beam passing holes than at the position aligned with and corresponding to the central electron beam passing hole.

24. An electron gun for a color CRT comprising:

a triode portion including cathodes for emitting electron beams, a control electrode, and a screen electrode;

first and second focusing electrodes located on a common axis with the triode portion;

third, fourth, and fifth focusing electrodes for forming a quadrupole lens; and a final focusing electrode adjacent the fifth focusing electrode, forming a large diameter lens, and including and opening through which three electron beams commonly pass, the three electrode beams lying in a horizontal plane and including a central electron beam and two side electron beams on opposite sides of the central electron beam wherein the third, fourth, and fifth focusing electrodes include a correction unit providing a correction force acting on the two side electron beam when a dynamic voltage, synchronized with a deflection signal, is applied to at least one of the third and fifth focusing electrodes for forming the quadrupole lens.

25. The electron gun as claimed in claim 24, wherein a constant voltage is applied to the screen electrode and the second focusing electrode, a focus voltage higher than the constant voltage is applied to the first and fourth focusing electrodes, the dynamic focus voltage synchronized with a deflection signal applied to the third and fifth focusing electrodes uses the focus voltage as a base voltage, and an anode voltage higher than the constant, focus, and dynamic focus voltages is applied to the final focusing electrode.

26. The electron gun as claimed in claim 24, wherein the fourth focusing electrode is a plate electrode, the correction unit includes respective plates of the third, fourth, and fifth focusing electrodes, each plate including a central and two side electron beam passing holes having respective vertical lengths perpendicular to the horizontal plane and horizontal lengths in the horizontal plane, in the fourth focusing electrode, the vertical and horizontal lengths of the central electron beam passing hole are smaller than the vertical and horizontal lengths of the side electron beam passing holes, in the third focusing electrode, the vertical length, but not the horizontal length, of the central electron beam passing is larger than the vertical length and the horizontal lengths of the side electron beam passing holes in the fifth focusing electrode, and in the fifth focusing electrode the horizontal length, but not the vertical length, of the central beam passing hole is smaller than the horizontal lengths and vertical lengths, respectively, of the side electron beam passing holes in the fifth focusing electrode.

* * * * *